United States Patent [19]

Knoche et al.

[11] 4,368,623

[45] Jan. 18, 1983

[54] METHOD AND APPARATUS FOR USE OF HEAT TAKEN UP AT LOW TEMPERATURE

[76] Inventors: Karl F. Knoche, Wiesenweg, D-5100 Aachen-Horbach; Heinrich Trümper, Engler Strasse, D-7500 Karlsruhe; Dieter Stehmeier, Schlossweiherstrasse 14, D-5100, Aachen, all of Fed. Rep. of Germany

[21] Appl. No.: 189,117

[22] Filed: Sep. 22, 1980

[30] Foreign Application Priority Data

Sep. 21, 1979 [DE] Fed. Rep. of Germany ..... 2938203

[51] Int. Cl.[3] ..... A63C 19/10; F25B 17/02

[52] U.S. Cl. ..... 62/235.1; 62/106; 62/478

[58] Field of Search ..... 62/106, 478, 235.1

[56] References Cited

U.S. PATENT DOCUMENTS

| | | | |
|---|---|---|---|
| 1,506,531 | 8/1924 | Kasley | 62/478 X |
| 1,729,083 | 9/1929 | Miller et al. | 62/478 X |
| 1,960,824 | 5/1934 | Munters | 62/106 |
| 2,138,686 | 11/1938 | Altenkirch | 62/106 X |
| 4,199,952 | 4/1980 | Berg | 62/478 X |
| 4,224,803 | 9/1980 | Greiner | 62/106 |

*Primary Examiner*—Lloyd L. King

*Attorney, Agent, or Firm*—Burns, Doane, Swecker & Mathis

[57] ABSTRACT

A method and apparatus for the use of heat taken up at low temperature is disclosed wherein a flow of transfer medium is passed through a low temperature heat source to absorb heat. The flow then passes through multiple, sequential stages of a heat pump which successively increase in temperature whereby the flow picks up heat. The flow then releases heat to the heat receiver and subsequently passes through multiple sequential degassing stages of the heat pump. The flow releases evaporation heat and is cooled to a suitable temperature for use in the low temperature heat source. The heat pump preferably includes a two substance mixture provided within a two portion, hermetically sealed chamber.

13 Claims, 12 Drawing Figures

METHOD AND APPARATUS FOR USE OF HEAT TAKEN UP AT LOW TEMPERATURE

BACKGROUND AND SUMMARY OF THE PRESENT INVENTION

The present invention relates generally to a process for using heat taken up at a low temperature, which heat is delivered at higher temperature to a heat receiver, through the intermediary of a multi-stage absorption heat pump.

A process of this type is known from Ger. OS No. 2743488. In the known process, solar energy is utilized for space heating. Heat is taken up from the solar collector by a cooling medium which is evaporated in the solar collector. The cooling medium, which comprises a weak solution of two working substances, is transported to a first absorber which operates with a strong solution, and the absorption heat produced in said first absorber is passed to a heating circulation loop. In the known process, the weak solution of the two working substances used to pick up the low temperature heat is passed through the solar collector, and the cooling medium which is evaporated there, (which comprises the strong solution of the two working materials), is passed into the absorber. For regeneration of the weak solution passed to the solar collector and the strong solution passed to the absorber, several separator and reabsorber stages are necessary, as well as pumps to pass the weak solution to the solar collector and to pass the strong solution of the two working substances to the absorber.

The known process has the disadvantage that the two working substances, for example, water as the cooling medium and aqueous lithium bromide as the liquid absorption material, are both passed to the collector. This occasions relatively high material costs for the collector, the feed and the removal pipes, and the pumps and valves—all of which come into contact with the two working substances.

The underlying problem of the present invention is to devise a process for use of heat taken up at relatively low temperature which avoids the disadvantages of known processes, which is more economical and reliable than the known processes, and which can be carried out with equipment which is simply designed and can be reduced at low cost, and which equipment furthermore is not very noisy in operation.

This problem is solved according to the invention, whereby a flow of each transfer medium, for example water or oil, (a) is passed through a low temperature heat source and absorbs heat there;

(b) then passes through multiple sequential stages of the absorption heat pump, which successively increase in temperature, whereby the flow picks up absorption heat and is heated up to the temperature needed by the heat receiver; whereafter (c) the flow releases heat to the heat receiver; and (d) then passes through multiple sequential degassing stages of the absorption heat pump which are coordinated with the absorber stages, whereby it releases evaporation heat and is cooled to a suitable temperature for use in the low temperature heat source.

This process can be carried out as long as the return flow of the heat transfer liquid from the heat receiver evaporates the cooling medium in the degassing stages. It is proposed, in a preferred embodiment of the invention, to regenerate the weak solution of the two working substances in the degassing stages and to regenerate the strong solution of the two working substances in the absorber stages. It is furthermore preferred that a heat transfer medium stream which is heated, e.g., by a gas or oil burner, first be passed through the absorber stages which are working as separators. In this way, the cooling medium may be driven off from the strong solution and then condensed in the degassing stages (which are associated with the respective absorber stages and which operate as resorbers), with the condensation being accompanied by the liberation of heat, and whereby the cooling medium may be absorbed by the weak solution.

Furthermore, the heat transfer medium flow which is cooled in this manner is preferably passed to a heat receiver, with the return flow of the heat transfer medium then passing through the degassing stages (which are operating as resorbers) whereby the flow absorbs the condensation heat and becomes heated up to the initial temperature. Such a regeneration of the weak solution and the strong solution of the pair of working substances is preferably continued until the two working substances reach their original lower concentrations in the degassing stages and their original higher concentrations in the absorber stages.

The inventive process can be applied to great advantage if, for example, high-grade heat energy is available for short and irregular periods of time. If an arrangement is available for the use of, for example, solar energy, geothermal energy, or other low temperature heat, as well as sometimes also high-grade energy, for example, exhaust gas heat, then the arrangement can be switched over with no pause or delay. Thereby, during the periods in which the high-grade energy is available, the pair of working substances are regenerated in the degassing and absorber stages.

The present inventive process has the advantage that each set of associated degassing and absorber stages can be set up in advance as an absorption unit which is completely closed to the outside. With an absorption heat pump operating according to the inventive process, the degasser and absorber are divided into multiple associated degassing and absorber stages, each adjusted to particular evaporation temperatures associated with the given stage, and having a common vapor space. Each degassing stage and its associated absorber stage are part of a hermetically sealed chamber filled with a pair of working substances, and set at a desired pressure. The chamber walls of the degassing stages are disposed within a first flow conduit for a heat transfer medium, with the chamber walls of the absorber stages being disposed in a second flow conduit which is separate from the first. The heat transfer medium flow coming from the source of low temperature takes up absorption heat, by flowing around or through the individual absorber stages, while the return flow of the heat transfer medium flows through the individual adsorption stages in the opposite direction and releases heat to the degassing stages, until the heat transfer medium has been cooled to a temperature in which it is in condition to pick up heat again in the low temperature heat source (which is, for example, a solar collector).

BRIEF DESCRIPTION OF THE DRAWINGS

Preferred embodiments of the present invention are described with reference to the accompanying drawings wherein like members bear like reference numerals and wherein.

DETAILED DESCRIPTION OF THE PREFERRED EMBODIMENTS

Figure 1:
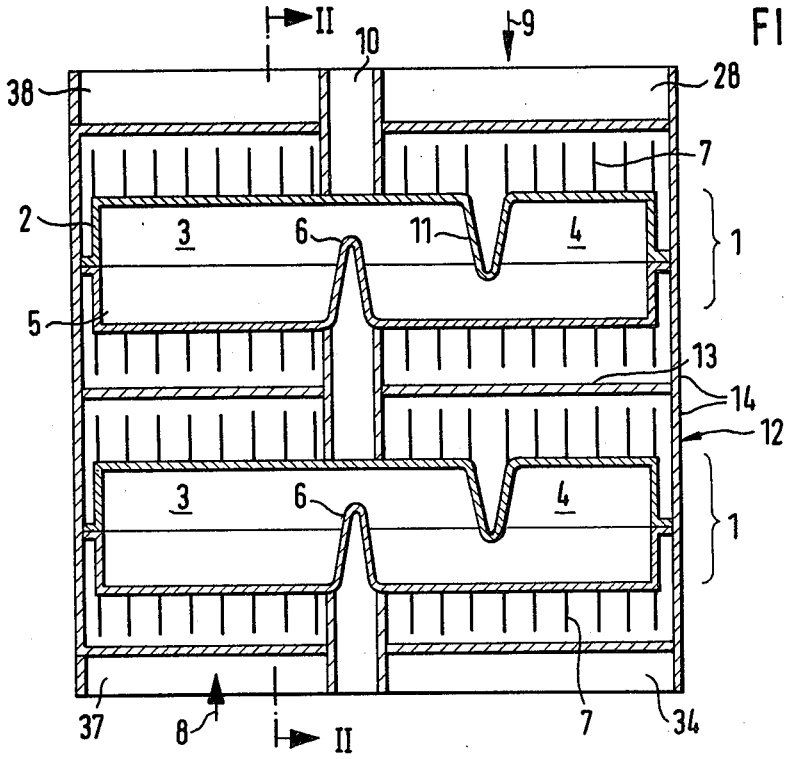
FIG. 1 is a schematic cross-section of a two-stage heat pump according to the present invention.
Figure 2:
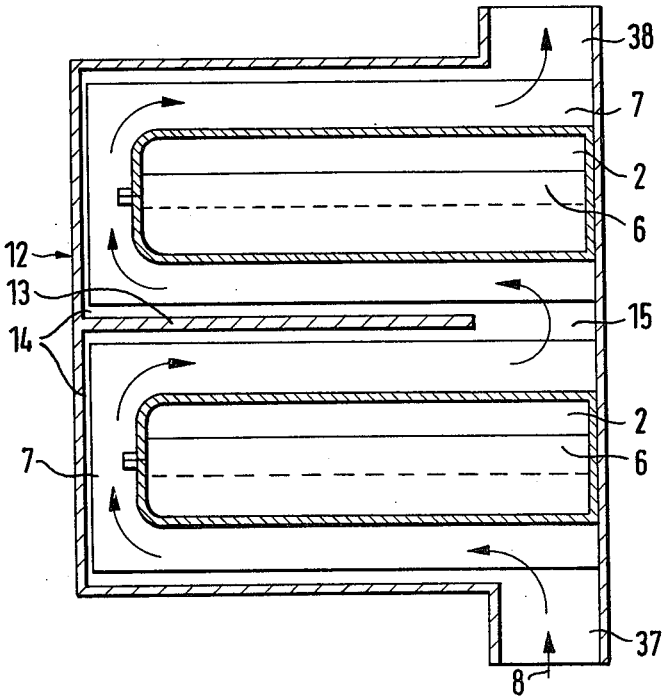
FIG. 2 is a view through line II—II of FIG. 1.

An absorption heat pump which is a combination of at least two absorption units 1 according to the present invention is disclosed with reference to FIGS. 1 and 2. Each absorption unit 1 comprises a hermetically closed chamber 2 which is subdivided into a degassing portion 3 and an adsorber portion 4. The chamber 2 is filled with a two-substance mixture 5 which is suitable for the absorption process, and the chamber 2 is adjusted to a pressure which corresponds to the particular stage of the heat pump.

The degassing portion 3 is separated from the absorber portion 4 by a separating wall 6 which is disposed such that the liquid two-substance mixture 5 cannot pass over from one portion of the chamber 2 into the other portion, although the cooling medium vapor can so pass.

The degassing portion 3 and the absorber portion 4 are provided in a heat exchange relationship with two heat transfer media streams 8 and 9, via a plurality of large contact surfaces 7. The heat transfer streams 8 and 9 are separated from one another by an insulating wall 10. The higher-temperature heat transfer media stream 8 flows around or through the degassing portion 3, and releases heat to the weak solution of the two-substance mixture which is diluted and which is located in the degassing portion 3. In this way, a part of said weak solution is evaporated and passes to the absorber portion 4, where the concentrated strong solution of the two-substance mixture is located, and the vapor liberated in the degassing portion 3 is absorbed by the strong solution.

The heat released thereby (i.e., in the absorption of the vapor into the liquid) is delivered to the heat transfer media stream 9 via the heat exchange surfaces of the absorber portion 4. A deflecting or rerouting wall 11 is disposed in the absorber portion 4 which wall 11 extends from the top of the chamber to the surface of the strong solution. This wall 11 serves to put the vapor into better contact with the strong solution, and to produce a certain movement on the surface of the strong solution. The chamber 2 may be fabricated from two deep-drawn pans made of sheet metal. By reason of the double-walled nature of the separating wall 6, and the insulating wall 10, it is ensured that no substantial amount of heat can pass through the chamber walls from the degassing portion 3 to the absorber portion 4 or vice-versa.

When the weak solution of the two-substance mixture has been enriched to the extent that only small amounts of cooling medium continue to be evaporated, the weak and strong solutions of the two-substance mixture 5 can be regenerated by operating the absorber portion 4 as a separator and the degassing portion 3 as a resorber. For this purpose, the temperature of the stream of heat transfer medium 9 is increased such that the medium 9 is cooled while flowing around the portion 4 (which is acting as a separator). The stream 8 of heat transfer medium, for its part, is heated up, by flowing around the portion 3 of the heat pump which is now acting as a resorber.

In order to increase the temperature of a stream of heat transfer medium by, for example, 30° C. around 10 to 30 absorption units 1 are necessary which are adjusted to each other and in which the same two-substance mixtures, but at different pressures, are established.

It is also possible to fill the absorption units 1 with different two-substance mixtures each of which is optimized for the given stage of the absorption heat pump.

Figure 3:
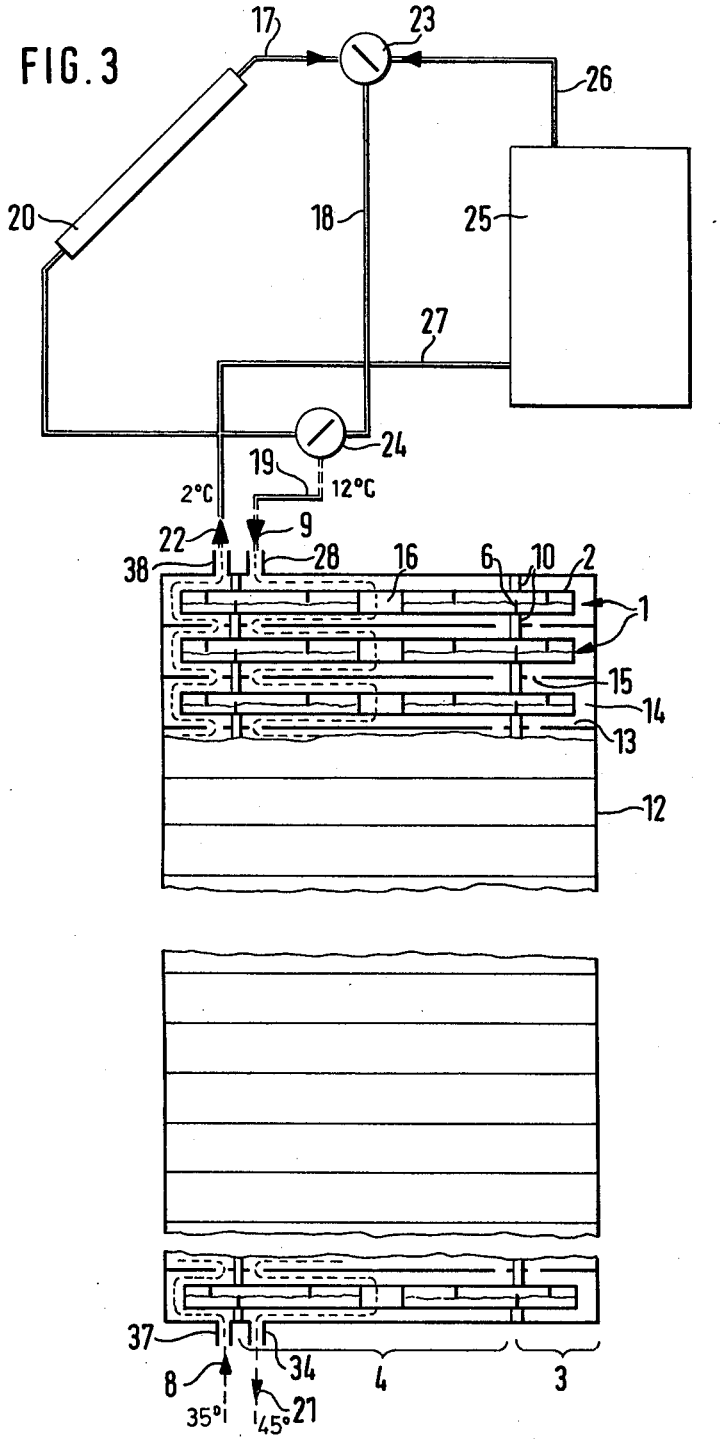
FIG. 3 is a schematic representation of an arrangement for utilizing solor energy with the aid of a multi-stage absorption heat pump according to the present invention.
Figure 4:
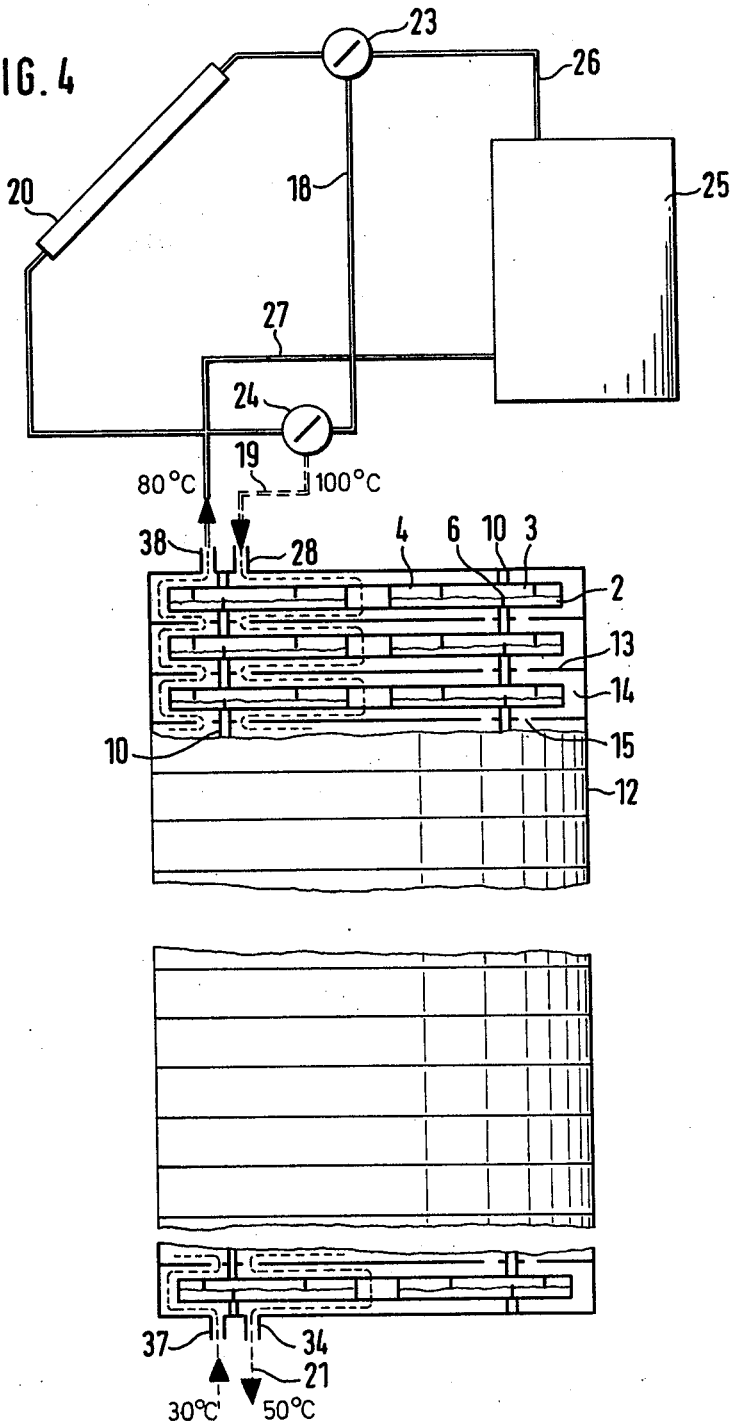
FIG. 4 depicts the arrangement of FIG. 3 in the regeneration mode.

The heat pumps with reference to FIGS. 3 and 4 may comprise a large number of disk-shape absorption units 1—the number being for example 10 to 30. Each unit has a chamber 2 which is circular in cross-section and which is divided by a ring shaped mounted wall 6 into an outer degassing portion 3 and an inner absorber portion 4, such that the liquid cannot pass from one chamber portion into the other, while the vapor of the cooling medium can so pass.

The absorption units 1 are sequentially disposed at intervals from each other in a container 12 which is divided into cells 14 by intermediate walls 13, each of which cells accommodates one absorption unit 1. Pass-through openings 15 are provided in the intermediate walls 13 for conducting the streams of the heat transfer mediums 8 and 9. Ring-shaped insulating walls 10 separate the stream 9 of heat transfer medium (which flows around the inner, absorber portions 4 of the absorber units) from the stream 8 of heat transfer fluid (which flows around the outer, degassing portions 3 of the absorption units). The round, disk-shaped absorption units 1 are provided in their middle parts with a pass-through opening 16.

During operation of such an absorption heat pump for utilization of low temperature heat, for example solar energy, with reference to FIG. 3, the heat transfer fluid is heated in a low temperature heat source 20, for example a solar collector, to a temperature of, e.g., 2° to 12° C. The thus warmed heat transfer fluid flows sequentially by way of a pipe 17, a 3-way valve 23, a pipe 18, a second 3-way valve 24, and a pipe 19 as the heat transfer fluid stream 9, to the absorber portion 4 of the vertically stacked absorption units 1 of the heat pump. At that time, heat exchanges between the fluid and the absorption units.

While flowing around the absorber portions 4, the heat transfer liquid is heated, (by the absorption of the cooling medium in the individual staged absorption units 1), to a temperature which is suitable for low-temperature space heating (for example 45° C.). The flow of the heat exchange medium 9 then passes as the first flow 21 into a heating circulation loop, from which it returns as the heat transfer medium stream 8 with a temperature of, for example, 35° C. The stream 8 then passes into the degassing portion 3 of the absorption heat pump. The liquid coming in the return flow then flows around the respective degassing portions 3 of the staged absorption units 1, and in the process is cooled, for example to a temperature of 2° C., whereupon the stream 8 can then be reheated in the low temperature heat source 20. This type of absorber operation is possible as long as sufficient concentration differences of the two-substance mixture 5 exist between the absorber portion 4 and the degassing portion 3 of each absorption unit 1.

If these concentration differences diminish over long term operation, the weak solution in the degassing portion 3 and the strong solution in the absorber portion 4 must be regenerated. This can be carried out, with reference to FIG. 4, upon actuation of the two 3-way valves 23 and 24. The liquid flow loop through the low temperature heat source 20 is shut off from the absorber units and is instead connected to the flow loop of a heating vessel 25. Then the flow loop liquid at higher temperature, for example 100° C., is passed through a pipe 26, the 3-way valve 23, the pipe 18, second 3-way valve 24, and the pipe 19 into the absorption units 1. The flow loop liquid can now exchange heat with the inner portions 4 (which are operating as a separator), whereby the cooling medium from the highly concentrated solution of the two-substance mixture is driven off and is resorbed in the outer portions 3 of the respective absorption units 1. By this process, the heat transfer fluid is cooled, for example to a temperature of 50°, whereby it can then be sent to the heating circulation loop. The return flow from the heat circulation loop is used to take up the resorption heat from the portions 3. The heat exchange fluid is heated by flowing around the outer portion 3 of the staged absorption units 1 which are operating as resorbers. This heating takes the temperature of the flow loop liquid from, e.g., 30° C., to, e.g. 80° C., whereby it is returned to the heating vessel 25 via a pipe 27.

A particular advantage of this absorption heat pump, in addition to its simple configuration, lies in the fact that, by way of a reduction of the forward and back flow temperatures or an increase in the temperature in the low temperature heat source 20, the ratio of the heat released into the heating circulation loop and the heat which is to be picked up from the heating vessel 25 is improved. Such a flexibility has as a principal consequence a particularly low need for the application of heat energy from fossil fuels. Thus the expense for controlling such an arrangement is minimal.

The arrangement of the absorber portions 4 which also act as separator, (in the interior of the disk-shaped absorption units 1), and the arrangement of the degassing portions 3, which also act as resorbers, (in the outer ring region of absorption units 1), has the result that the respective higher temperature portions and the heat transfer fluids are separated from the lower temperature portions and heat transfer fluids, and thus only relatively low heat losses can occur.

Figure 5:
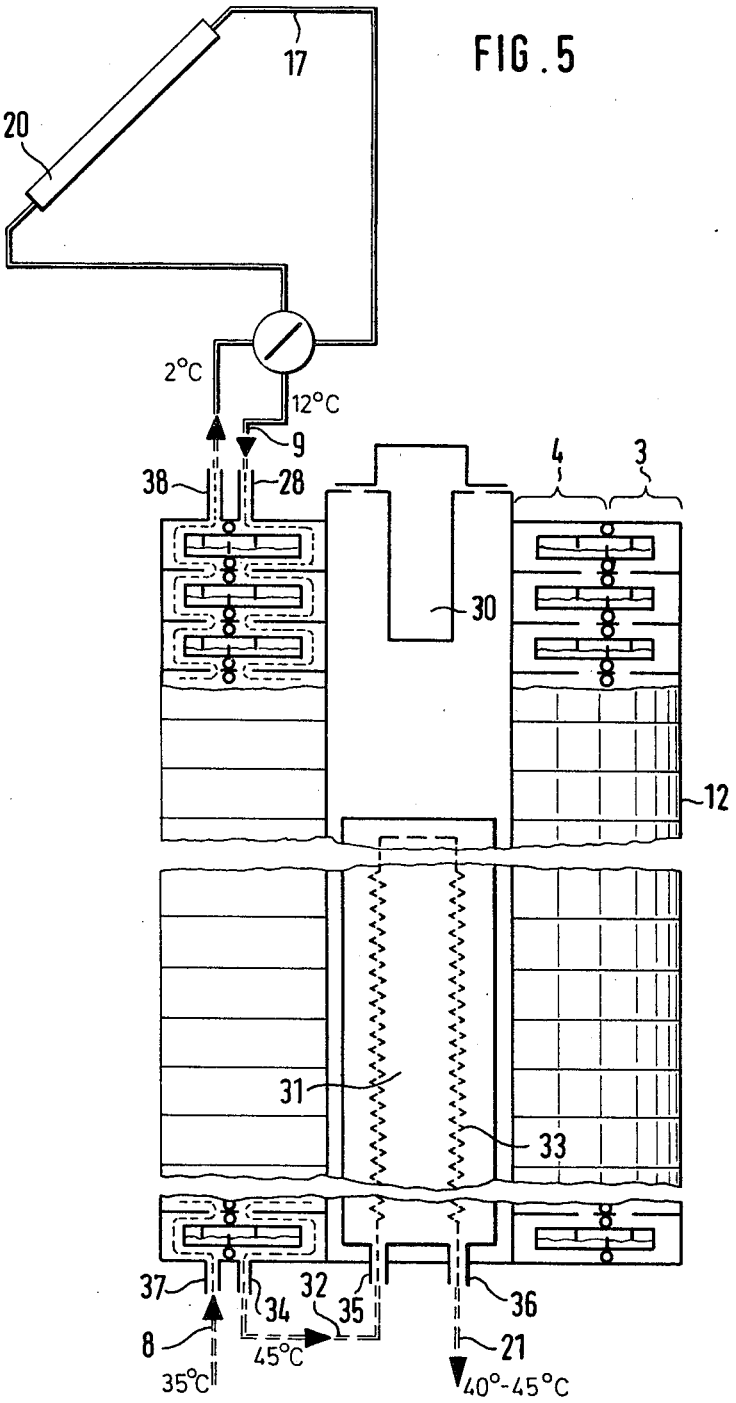
FIG. 5 shows an arrangement with a multi-stage absorption heat pump including a warm water container and a burner operating on gas, coal, or oil.
Figure 6:
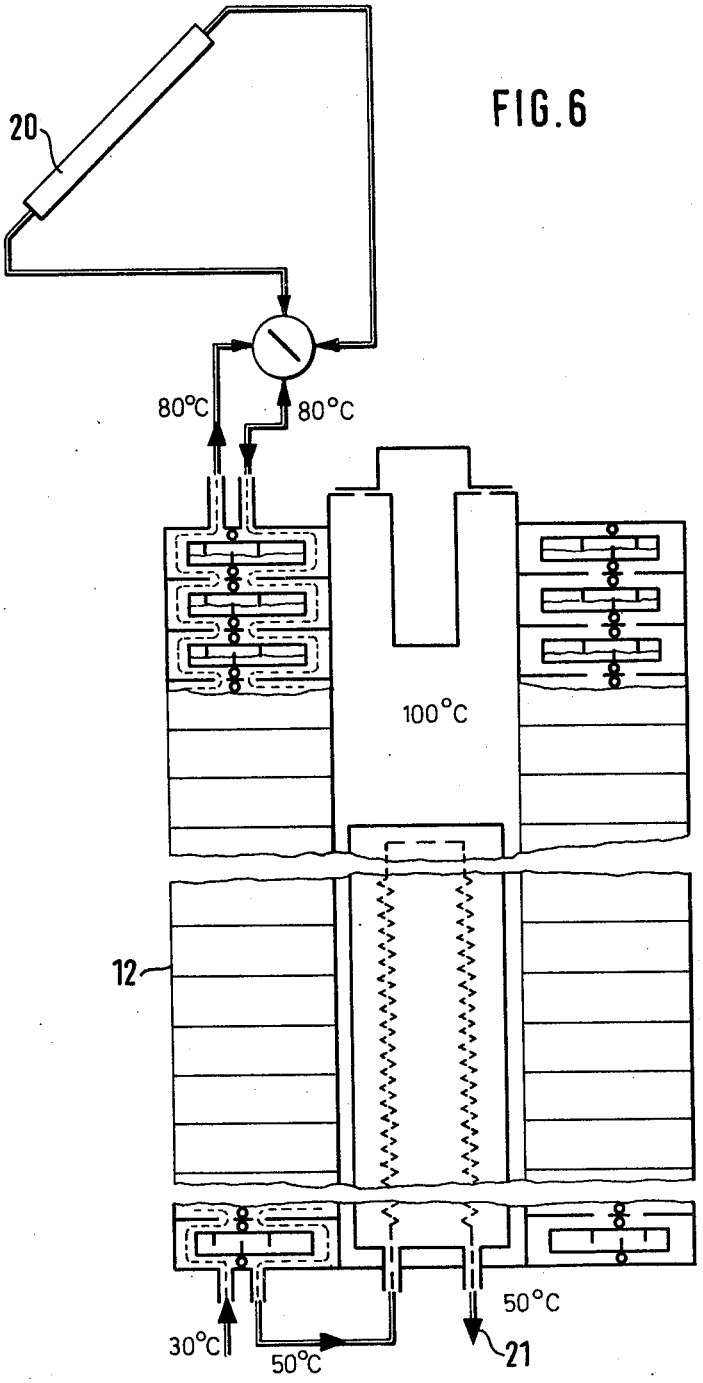
FIG. 6 shows the arrangement of FIG. 5 in the regeneration mode.

With reference now to FIGS. 5 and 6, an absorption heat pump according to the present invention is combined with a centrally located burner 30 of oil, coal, or gas, and a warm water container 31 is incorporated for supplying the water which is consumed. Under this arrangement the flow 9 of heat transfer fluid which is heated from 12° to 45° C. in the absorber portions 4 of the absorption units 1 is passed through a pipe 32 into a heat exchanger 33 of the warm water container 31 prior to the time that the flow 9 becomes the initial flow 21 of the heating circulation loop. In the return flow from the heating circulation loop, the stream 8 of heat-transfer fluid is passed to the degassing portions 3 of the absorption units 1, where the stream is cooled to around 2° C., so that the stream 8 can again go to the solar collector 20 to pick up heat.

To regenerate the relatively weak and strong solutions of the two-substance mixture or mixtures in the staged absorption units 1, the outlet 38, as shown in FIG. 6, of the flow of heat transfer fluid which has passed around the outer portion 3 of the absorption units 1 is combined, via a pilot valve 29, with the input 28 of the straight flow 9 of heat transfer fluid which is passed around the inner portions 4 of absorption units 1; and the burner 30 is started up. The absorber portions 4 of the absorption units 1 now act as separators, while the degassing portions 3 of the absorption units 1 now act as resorbers. The burner 30 heats the flow 9 of heat transfer fluid in the initial stages of the heat pump to around 100° C. This flow 9 of heat transfer fluid is then cooled by flowing around the inner portions 4 of absorption units 1, which inner parts are acting as separators, to about 50° C., and is then passed through heat exchanger 33 of warm water container 31, whereafter it is passed as initial flow 21 into the heating circulation loop. The return flow from the heating circulation loop is passed, as flow 8 of heat transfer fluid, around the outer portions 3 of the absorption units 1, which parts are acting as resorbers, whereby said flow is heated to a temperature of about 80° C.

A good utilization of the heat input from the burner 30 is achieved by reason of the central location of the burner 30 inside the initial, and relatively lower temperature, ring-shaped absorption stages 1 of the heat pump, and by reason of the central location of the warm water container 31 inside the relatively higher-temperature absorption stages.

Figure 7:
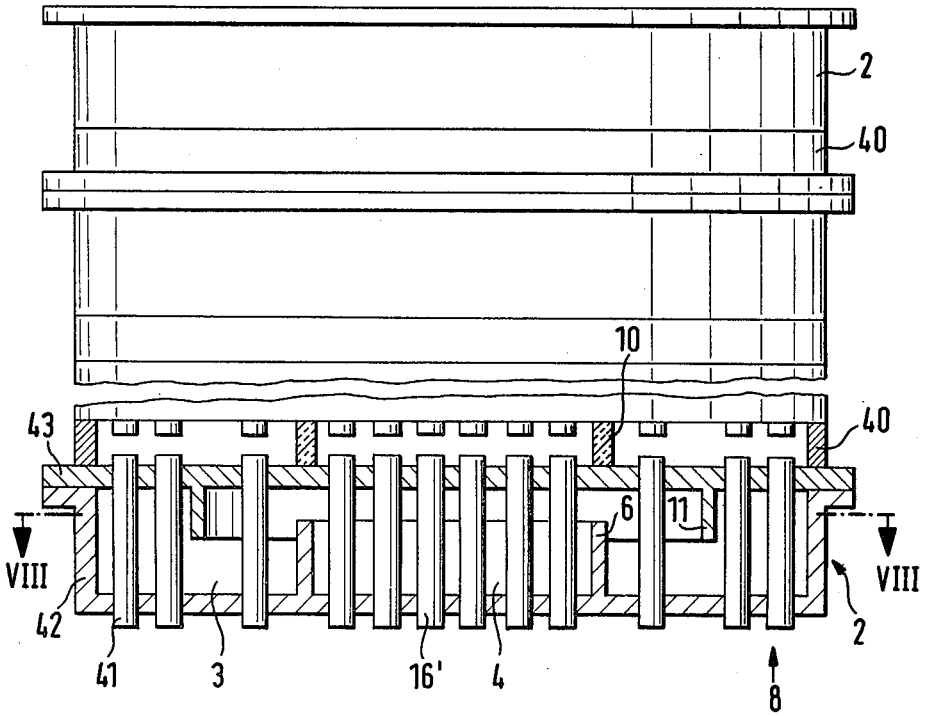
FIG. 7 is a side view of another absorption unit according to the present invention.
Figure 8:
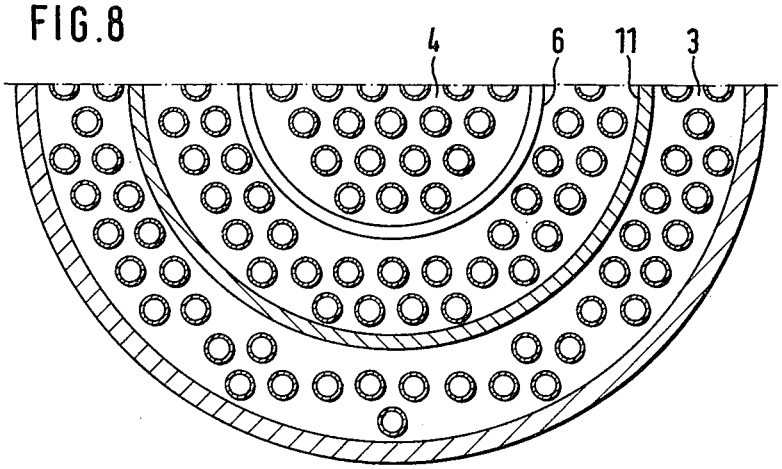
FIG. 8 is a view through line VIII—VIII of FIG. 7.

With reference to FIGS. 7 and 8 absorption units or absorption stages 1, each of which is a combination of a wall 42 and a cover 43 of a hermetically closed chamber 2 are disclosed. The wall 42 has a ring shaped separating wall 6 disposed in it, and the cover 43 has a ring shaped deflecting wall 11 disposed in it. Between adjacent chambers 2 there are disposed a ring-shaped insulating wall 10 and a ring-shaped outer wall 40. The flow passage 8 through the degassing portions 3 is formed from tube-like pass-through openings 41 and the innerstitial area between the insulating wall 10 and the outer wall 40. The flow passage 9 through the absorber stages 4 is formed from tube-like pass-through openings 16' and the space inside of ring-shaped insulating walls 10.

Figure 9:
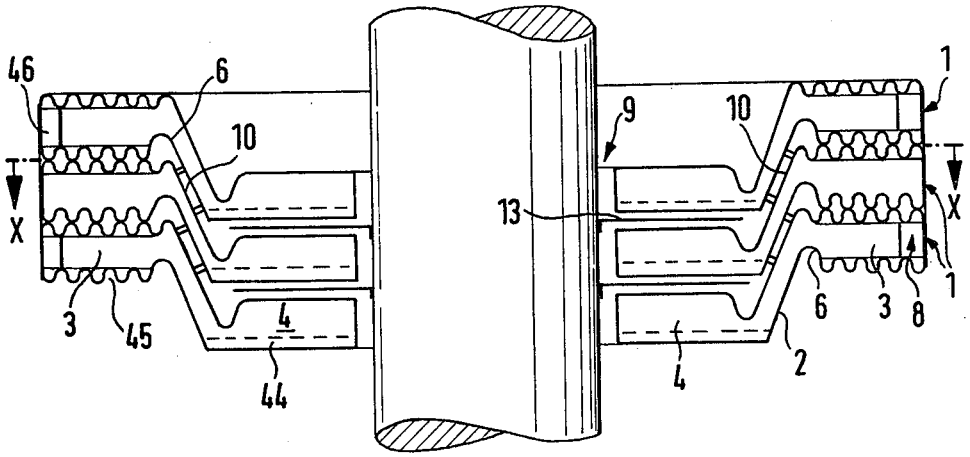
FIG. 9 is a side view of still another absorption unit according to the present invention.

In FIG. 9, three absorption stages 1 are represented, in each of which there are ring-shaped hermetically closed chambers 2, with the absorber portion 4 of each chamber being disposed lower than the degassing portion 3. The chamber 2 is a combination of the two deep-drawn sheet metal pans, in which radially running corrugations 44 and concentrically running corrugations 45 are stamped in order to increase the surface area. The flow path 8 through the degassing portions 3 runs along corrugations 45 and through the openings 46 on the periphery of the chamber 2. The flow path 9 through the absorber portions 4 runs along the radial corrugations from inside to outside, and then around the intermediate wall 13 to the next absorber stage 4.

Figure 10:
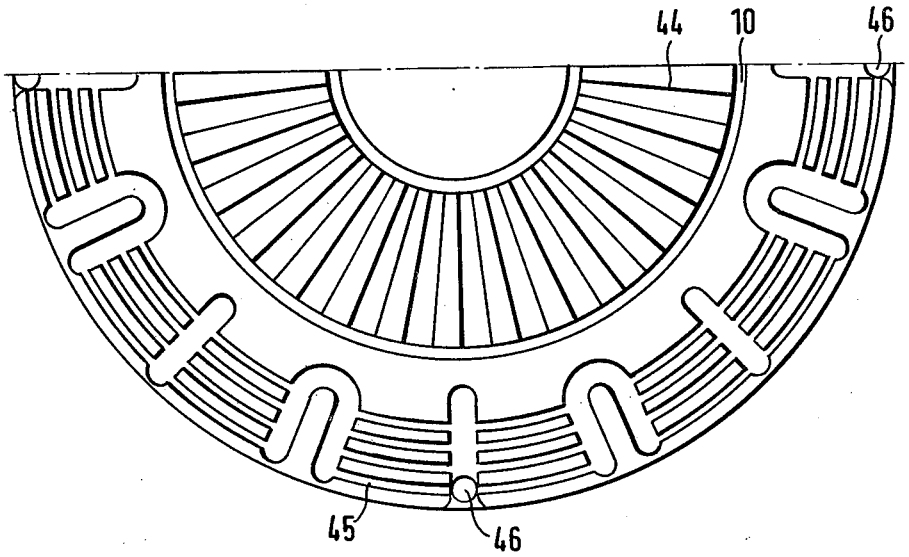
FIG. 10 is a view through the line X—X of FIG. 9.

With reference to FIG. 10, the arrangement of the corrugations and portions of the chamber 2 may be seen.

Figure 11:
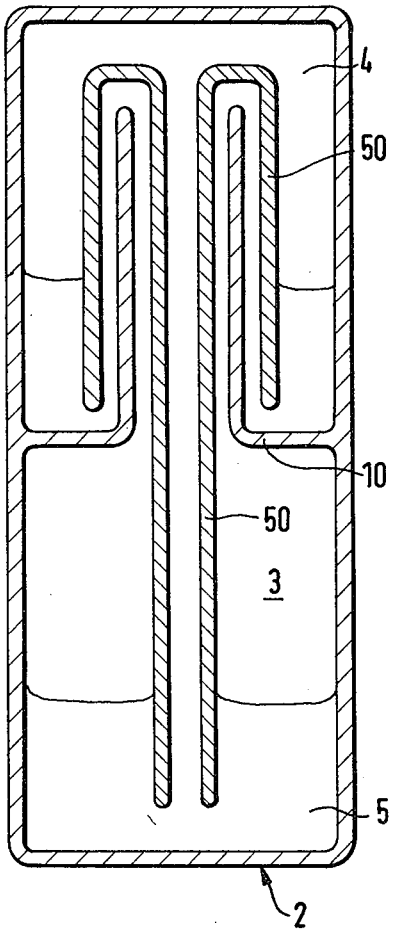
FIG. 11 is a cross-sectional view of an absorption unit according to the present invention having a medium flow which is primarily vertical.
Figure 12:
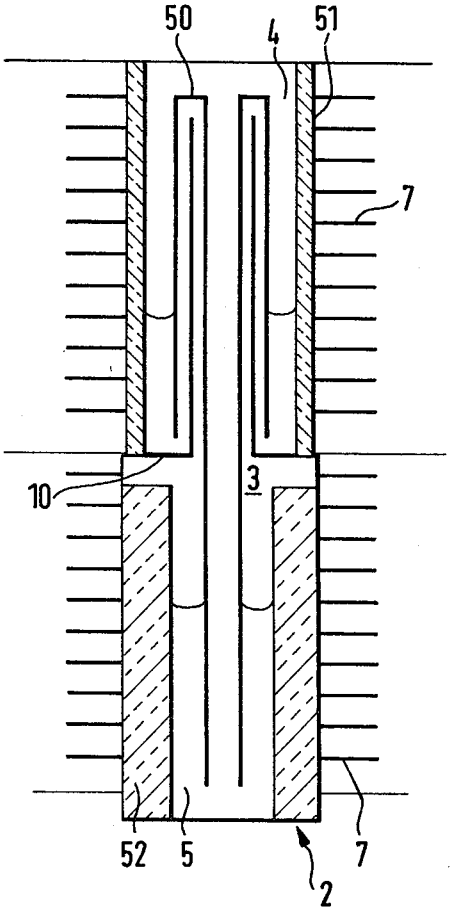
FIG. 12 is a cross-sectional view of another absorption unit according to the present invention having a medium flow which is primarily vertical.

FIGS. 11 and 12 show vertically running absorption units each having a lower degassing portion 3 and an upper absorber portion 4. The wall 10 separates the relatively strong solution of the absorber portion 4 from the relatively weak solution in the degassing portion 3.

A vapor guiding wall 50 ensures that the vapor rising from the degassing portion 3 is passed through the relatively strong solution of the absorber portion 4, and that, in the regeneration mode, the vapor driven off in the absorber portion 4 is forced under the surface of the solution in the degassing portion 3, which degassing part is operating as a resorber.

As FIG. 12 shows, the contact surfaces of the solution in the degassing portion 3 and in the absorber portion 4 can be increased by means of "capillary" walls 51 and wick "walls" 52 mounted there.

The principles, preferred embodiments and modes of operation of the present invention have been described in the foregoing specification. The invention which is intended to be protected therein, however, is not to be construed as limited to the particular forms disclosed, since these are to be regarded as illustrative rather than restrictive. Variations and changes may be made by those skilled in the art without departing from the spirit of the invention.

What is claimed is:

1. A process for utilizing heat taken up at relatively low temperature, which heat is transferred at a higher temperature to a heat receiver, via the intermediary of a multistage absorption heat pump, and in which absorption stages of the absorption heat pump are regenerated periodically by relatively high temperature heat, comprising the steps of:

passing a flow of heat transfer medium through a source of relatively low temperature heat to absorb heat;

passing the heat transfer medium through multiple sequential absorption stages of the absorption heat pump, which stages increase in temperature from stage to stage, said medium picking up absorption heat and being thereby heated to a temperature required for the heat receiver;

transferring heat from the heat transfer medium to the heat receiver;

subsequently passing the heat transfer medium through multiple sequential degassing stages of the absorption heat pump, which degassing stages are coordinated with the respective absorption stages, and thereby using said heat transfer medium to release heat of vaporization and cooling said heat transfer medium to a suitable temperature for use in the source of relatively low temperature heat; and regenerating a relatively weak solution of a pair of working substances in the degassing stages and a relatively strong solution of the pair of working substances in the absorber stages by flowing the heat transfer medium at a relatively high temperature through the absorber stages, each operating now as a separator, whereby the relatively weak solution is driven off from the relatively strong solution and is then condensed in the respective associated degassing stage, now operating as a resorber, said condensation being accompanied by the liberation of heat which is removed from the relatively weak solution, the flow of the heat transfer medium which has been cooled in this manner being fed to a heat receiver, and wherein the return flow from said heat receiver is then passed through the degassing stage which is now operating as a resorber, whereby said flow picks up the heat of condensation and is subsequently reheated.

2. An absorption heat pump with at least one degassing unit in which a cooling medium from a weak solution of a pair of working substances is evaporated, and at least one absorber connected to said degassing unit, in which absorber the cooling medium which has been vaporized is absorbed by a strong solution, comprising:

a plurality of individually associated degassing stages and absorber stages, each pair of the degassing and the absorber stages being set at different evaporation and absorption temperatures and having a common vapor space, each associated degassing stage and absorber stage together comprising a chamber which is hermetically sealed to the outside, each chamber being filled with a pair of working substances, and being adjusted to a desired pressure, the chamber walls of the degassing stages being configured in the form of a first sequential flow path for a heat transfer medium, while the chamber walls of the absorber stages are configured in the form of a second sequential flow path which is separate from the first sequential flow path.

3. The absorption heat pump according to claim 2 wherein the chambers are in the form of a disc-like structure; and each absorber stage is disposed in the inner region of each respective chamber and each degassing stage is disposed in the outer region of each respective chamber.

4. The absorption heat pump according to claim 3 wherein each chamber has at least one pass-through opening in the interiorly disposed absorber stage, for the associated flow path.

5. The absorption heat pump according to claim 4 wherein each of the disc-shaped chambers is round, and wherein each chamber includes a separating wall and a deflecting wall inside the chamber, and also wherein an insulating wall is provided between adjacent chambers, said chambers being concentrically disposed with respect to one another.

6. The absorption heat pump according to claim 5 wherein each of the chambers is disposed in a cell of a container which is subdivided by intermediate walls, and wherein the flow path for the degassing stage of each cell runs from the outer surface of the insulating wall to the inner surface of the wall of the container and back, while the flow path for the absorption stage of each cell runs from the inner surface of the insulating wall to the central pass-through opening and back; and in that on both sides of the insulating wall there are pass-through openings in the intermediate walls.

7. The absorption heat pump according to claim 2 wherein the chamber is a combination of two deep-drawn sheet metal pans, with a double separating wall being built into the lower sheet metal pan and at least one deflecting wall being built into the upper sheet metal pan.

8. The absorption heat pump according to claim 2 wherein the chamber has a large number of tube-like pass-through openings for the flow paths, with said openings being disposed in large numbers both in the inner, absorber stage and in the outer, degassing stage.

9. The absorption heat pump according to claim 7 wherein each of the chambers of the respective absorption stages is provided within a container, with an inner ring-shaped insulating wall and a ring-shaped outer wall being mounted intermediately of each chamber.

10. The absorption heat pump according to claim 9 wherein the chambers and the cells each have ring configurations with a burner disposed in the region of the absorption stages having relatively lower evaporation and absorption temperatures, said burner being disposed within the ring-shaped cells; and, further comprising a water container disposed in the region of the absorption stages with relatively higher evaporation and absorption temperatures, said water container being also disposed within the ring-shaped cells.

11. The absorption heat pump according to claim 10 wherein the outlet of flow path is in fluid communication with the inlet of the heat exchanger disposed inside the water container, said communication being via the absorber stages and a pipe; and wherein the heat receiver is connected to the outlet of said heat exchanger.

12. The absorption heat pump according to claim 11 wherein the outlet of the flow path which passes through the degassing stages is selectively connectable to the inlet of the flow path which passes through the absorber stages, said connection being by way of a pilot valve.

13. The absorption heat pump according to claim 9 wherein the inlet of the flow path which passes through the absorber stages is selectively connectable to a pipe which comes from a low temperature source, and to a pipe which comes from a heating vessel, said connection being via a multiway valve; and wherein the outlet of the flow path passing through the depassing stages is selectively connectable to a pipe which leads to the low temperature source, and to a pipe which leads to the heating vessel.

* * * * *